United States Patent [19]

Kapolnek

[11] Patent Number: 4,896,573

[45] Date of Patent: Jan. 30, 1990

[54] APPARATUS FOR REMOVING SCRAP FROM A DIE CYLINDER

[75] Inventor: Paul G. Kapolnek, Chicago, Ill.

[73] Assignee: Western Printing Machinery Company, Schiller Park, Ill.

[21] Appl. No.: 212,338

[22] Filed: Jun. 27, 1988

[51] Int. Cl.[4] ..... B26D 7/18

[52] U.S. Cl. ..... 83/117; 83/103; 83/98; 83/100; 83/347

[58] Field of Search ..... 83/117, 116, 103, 98, 83/99, 113, 347, 100

[56] References Cited

U.S. PATENT DOCUMENTS

| | | | |
|---|---|---|---|
| 1,363,526 | 12/1920 | Malm . | |
| 1,678,896 | 7/1928 | Wood . | |
| 2,049,515 | 8/1936 | Potdevin . | |
| 2,546,069 | 4/1948 | Hart . | |
| 3,186,274 | 6/1965 | Winkler et al. | 83/103 |
| 3,277,756 | 10/1966 | DesJardins et al. | 83/116 |
| 3,946,627 | 3/1976 | Hofmann | 83/117 |
| 4,143,568 | 6/1977 | Cogswell | 83/116 |
| 4,367,069 | 6/1983 | Bishop | 83/117 |
| 4,463,640 | 8/1984 | Cogswell et al. | 83/116 |
| 4,466,319 | 8/1984 | Cogswell et al. | 83/116 |
| 4,640,165 | 2/1987 | McMahon et al. | 83/346 |
| 4,799,414 | 1/1989 | Scheffer et al. | 83/103 |

FOREIGN PATENT DOCUMENTS

| | | | |
|---|---|---|---|
| 1049581 | 11/1966 | United Kingdom | 83/116 |

*Primary Examiner*—Donald R. Schran
*Attorney, Agent, or Firm*—Olson & Hierl

[57] ABSTRACT

An apparatus for removing scrap around the die cut blanks in a web comprising a pair of rolls through which the web is passed, one roll carrying flexible pointed fingers arranged substantially parallel thereto for impaling the scrap pieces and the other roll carrying resilient material opposed said flexible pointed fingers to contact the scrap pieces so they may be impaled by the pointed fingers. Scrap pieces are impinged on the pointed fingers as the scrap pieces pass between the fingers and resilient material before the nip of the rolls and are pushed outwardly from the surface of the roll by the flexible point finger for removal by a comb, brush or vacuum means.

12 Claims, 2 Drawing Sheets

APPARATUS FOR REMOVING SCRAP FROM A DIE CYLINDER

BACKGROUND OF THE INVENTION

This invention relates to an improved apparatus for removing scrap around the die cut lengths in a web of paper or other materials such as foil, thin plastic, or webs of combined layers of these or similar materials. More particularly, this invention relates to a removable scrap control apparatus that is not attached permanently into the die cylinder on which it is used which permits the use of a double cutoff knife on the same die cylinder without having to have permanent holes, slots or other means to accommodate the scrap control apparatus on the die cylinder or anvil cylinder. Another embodiment relates to a scrap control apparatus for use with configured dies.

Paper cutting machines are widely used to straight or contour cut continuous web to desired sizes without any preliminary step of cutting the web into individual blanks. In general, rotary paper cutting machines have two cooperating rollers or cylinders, one which carries the straight knife or contour die, and the other acts as an anvil against which the knife or die bears as the paper is cut. The cutting edge of the knife and the surface of the anvil normally rotate at the same speed, and the paper is cut as the cutting edge of the knife moves into and out of engagement with the anvil surface. The dies are arranged to cut the maximum number of parts from the web, but inevitably areas of scrap material form because of the complexity of the shapes. At some point, some or all of the scrap is separated from the parts and the scrap is then removed from the die cylinder.

In the conventional rotary paper cutting machine, scrap pieces may be removed by suction alone or by the use of supplementary needles or points for spearing the waste pieces in conjunction with suction. Such points on the cylinder require corresponding openings in the anvil cylinder opposite such points. In some instances, these openings may be filled with rubber or similar resilient material, however, such openings interfere with setup of the machine to different formats or different locations for the pattern to be cut. Attention is required to see if the points or needles exactly register with the openings in the anvil cylinder. This creates difficulty in the changing of setup for different formats or even different positions and sizes of openings.

U.S. Pat. No. 3,186,274 describes a mechanism for removing scrap waste which includes resiliently mounted needles or spear points which in their normal position project from the periphery of the cutting cylinder so that they penetrate the scrap and yield on contact with the hard surface of the counter cylinder. The mounted needles or spear points hold the waste material during rotation of the cutting cylinder to a point where the waste material can be removed by suction. The resilient material comprises a spring for pushing the end of the point into the scrap material. The springs have a workable action to support the needles or points for penetration of the scrap, but are sufficiently yieldable to prevent blunting of the points against the hard surface of the die cylinder and to eliminate the necessity of recesses in the hard surface. Upon impaling, the scrap material is kept on the point near the surface of the die cylinder and by operation of a comb or brush and suction, is removed from the tips of the points. However, if the scrap is not elevated to a sufficient extent above the surface of die cylinder for pickup by the comb or brush for suction by vacuum means, there is a likelihood that it will not be removed. Further, there is danger of marking the anvil by the points which are sprung into the scrap pieces by resilient springs. The present invention is directed to overcoming these and other difficulties inherent in the prior art.

In the present invention an apparatus for removing scrap pieces is provided which includes flexible pointed fingers set into the knife holder or die cylinder between cutting knives or configured dies which contact scrap pieces so that they may be impaled by the pointed fingers. These scrap pieces are impinged on the pointed fingers as scrap pieces pass between the fingers and resilient material on the surface of the anvil cylinder before the nip of the cylinders. The resilient material may be cork, rubber or any elastomeric material. With the apparatus of the present invention, both the anvil cylinder and die cylinder are not damaged by the scrap removal device nor are unnecessary amounts of time required for setup of the knife roller and operation. Further, a specific phase relationship, or angular relationship of the cylinders is not necessary because of the absence of the need to register impaling points and specific positions on the opposing cylinder.

SUMMARY OF THE INVENTION

In the preferred embodiment of the invention, the apparatus for stripping scrap from the web on a knife or die cylinder comprises one knife or die cylinder carrying one or more flexible pointed fingers spaced between parallel knives or within a configured die for impaling scrap and the other roll or anvil cylinder having a resilient material directly opposed said flexible pointed fingers for impaling scrap onto said flexible pointed fingers. The resilient material impinges the scrap so that at the nip of the cylinders, the flexible pointed fingers impale the scrap pieces. As the cylinders turn away from the nip, the flexible pointed fingers spring outwardly to a position which is substantially elevated from the surface of the roll or cylinder so that the scrap piece may be removed from the extending flexible pointed finger by any suitable means such as a comb, brush or vacuum. After a complete rotation, upon reaching the nip of the cylinders, the flexible pointed fingers are again pressed inwardly by the radial and mechanical forces so that they may impale scrap pieces which are impinged on said resilient material oppositely located on the anvil cylinder. In one embodiment of the invention there is a rotary paper cutting apparatus comprising a knife assembly on a cylinder and a cooperating anvil cylinder against which the paper is cut. The knife and anvil cylinder assemblies rotate about parallel axes in timed relationship to the travel of the paper between them. The knife cylinder has affixed thereto a parallel knife blade assembly including scrap removing means comprising flexible pointed fingers attached between the knife blades. Directly opposed the flexible pointed fingers on the die cylinder is resilient material on the periphery of the anvil cylinder which assists the impaling of the scrap pieces by the flexible pointed fingers on the die cylinder.

DETAILED DESCRIPTION OF THE PREFERRED EMBODIMENT

Figure 1:
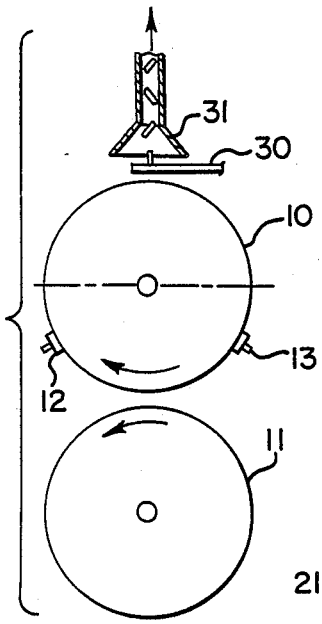
FIG. 1 is an end view, partly in section, of a portion of a rotary paper cutting apparatus showing the impaling device, knife and comb located adjacent to the die cylinder at about 190° from the nip of the cylinders and vacuum means for removing the scrap paper from the comb.
Figure 2:
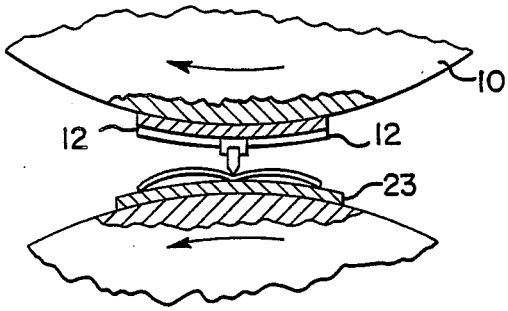
FIG. 2 is a fragmentary, exploded end view of the die and anvil cylinders and a cross-sectional view of the cork strips and impaling device.

Referring now to the drawing and particularly FIG. 1, there is shown a knife cylinder 10 adjacent to and above anvil cylinder 11. This arrangement is not intended to be limiting for the knife cylinder may be positioned below the anvil cylinder. A web, not shown, passes between the cylinders wherein double knife assembly 12, comprising double knife blades, extends longitudinally across the periphery of the surface of knife cylinder 10 with flexible pointed fingers 13 positioned between knives 12. Flexible pointed finger 13 comprises an attached end portion 14 mounted on double knife assembly on die cylinder 10 by bolt 15 so that the flexible pointed finger is attached to the knife assembly between the knives 12. The preferred embodiment comprises two flexible pointed fingers 13, oppositely positioned between the knives 12. However, more or less flexible fingers may be utilized. Flexible pointed finger 13 may be made from a flexible material such as spring steel so that it may be flexed outwardly away from the surface of anvil cylinder 10.

Figure 3:
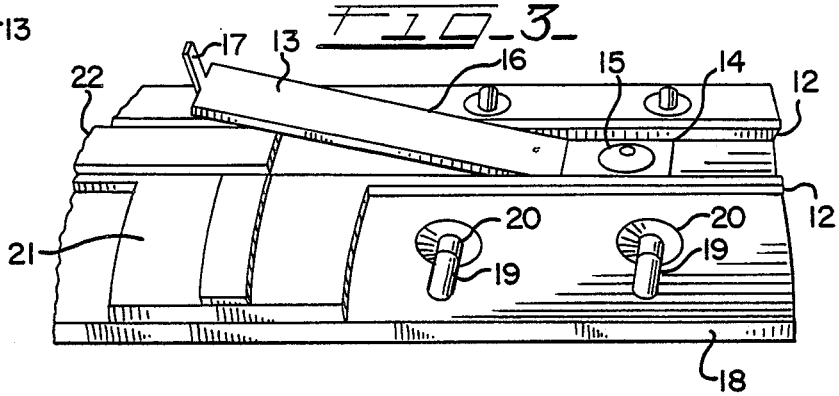
FIG. 3 is a partial perspective view of a portion of the impaling device showing a flexible pointed finger extending outwardly from the die cylinder.
Figure 4:
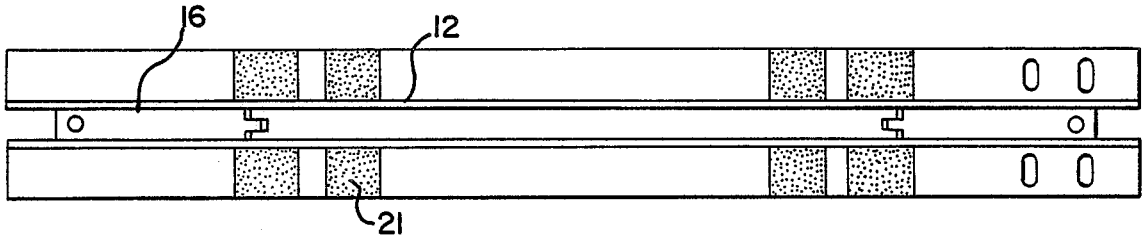
FIG. 4 is a top view of the entire impaling device showing the flexible pointed fingers attached to the die cylinder.
Figure 5:
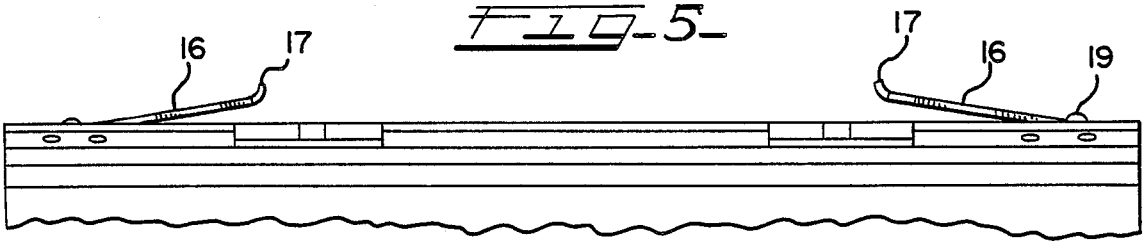
FIG. 5 is a side elevational view of the impaling device with the flexible pointed fingers extended away from the die cylinder.
Figure 6:
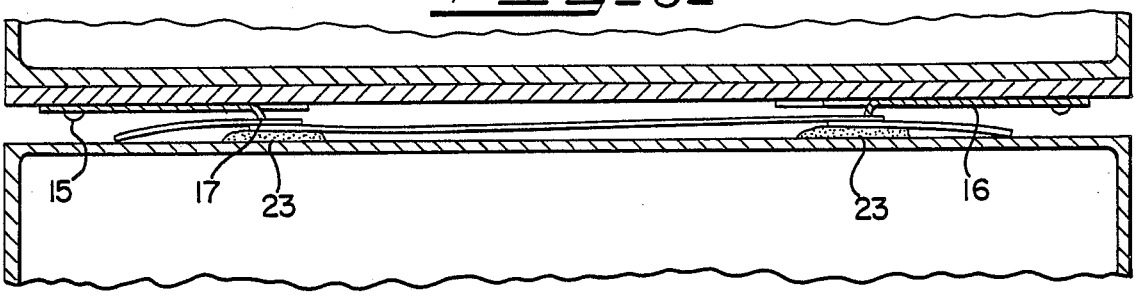
FIG. 6 is a side sectional view showing the pointed flexible fingers at the nip of the die cylinder and anvil cylinder impaling scrap paper on resilient materials.
Figure 7:
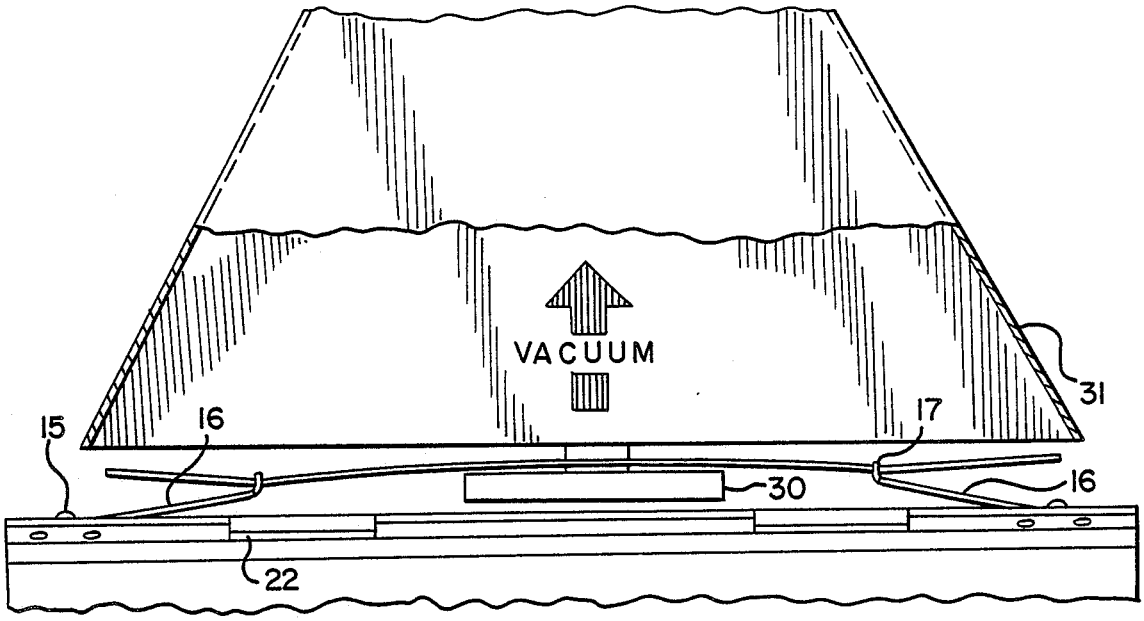
FIG. 7 is a side sectional view of the apparatus of the present invention showing vacuum means for removing scrap therefrom.

Mid-portion 16 of flexible pointed finger 13 is shown in FIG. 3 extended above the plane of the longitudinal axis of die cylinder 10 with a pointed end 17 extending the furthermost distance away from the surface of knife cylinder 10. Pointed end 17 is in a position substantially perpendicular to plane of mid portion 16 of the flexible pointed finger 17. Assembly 18 containing double knives 12 positioned on either side of flexible pointed finger 13 is attached to die cylinder 10 by removable bolts 19 set in recessed holes 20 for securing the assembly to the die cylinder. Web driving means 21 is attached adjacent to knives 12 on the assembly and cushioning means 22 is attached between knives 12 and partially beneath the flexible pointed fingers 13. The cushioning means absorb the impact of the flexible pointed finger 13 as it passes through the nip of the cylinders. The cushioning means may be made from material such as cork, rubber or any elastomeric material.

The knife cylinder 10 and anvil cylinder 11 are arranged so that when a web of paper is passed between them, the web may be severed at the desired places by action of the double knife 12 against the anvil cylinder 11. As shown in FIG. 3, the knife blades 12 extend from assembly 18 so as to intersect the paper web while it lies against anvil cylinder 11 where the web is cut into desired lengths or shapes. The severed parts, not shown, are received by conventional means, not shown, for delivery to further processing stations. Scrap material is impinged on resilient material 23 which may be cork, sponge, rubber or any elastomeric material. As the cylinders rotate, the scrap materials are impaled by tip 17 of flexible pointed fingers 13 as the finger is depressed against die cylinder 10 in the cutting nip of the cylinders. As the cylinders rotate in direction away from the cutting nip, flexible pointed finger 13 springs outwardly away from the surface of die cylinder 10 holding the scrap piece 24 as shown in FIG. 1 where it may rotate to comb or brush means 30 for removal therefrom. Once the scrap piece 24 is engaged in brush or comb 30, it may be removed by vacuum or other means 31 for disposal. The flexible pointed fingers 13 spring outwardly from the surface of the die cylinder at an angle upwards to about 15 degrees. The scrap piece is impaled on tip 17 under tension for secure holding until the rotation of the knife or die cylinder positions the scrap piece at the point of release. Combing device 30 removes the scrap piece in a facile manner from impaling point 17 of flexible pointed finger 13 so that the scrap piece can be removed by a vacuum or other means 31. This insures the reliable control and removal of scrap pieces from the knife or die cylinder.

The scrap control device of the present invention is easily attached to or removed from the double knife assembly or alternately from a configured cutting die assembly. The double knife assembly 18, can be easily removed or adjusted including the scrap control device, from knife or die cylinder 10 by loosening or adjusting bolts 19 in recess 20.

Figure 8:
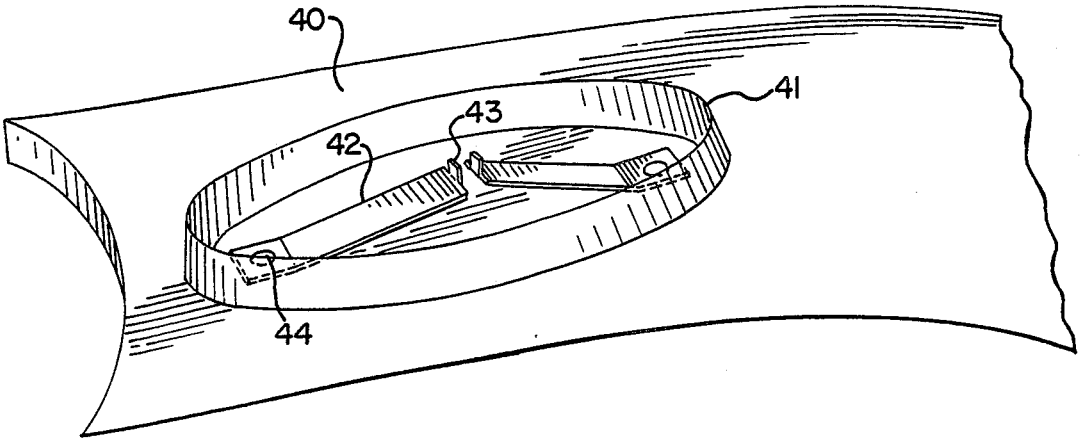
FIG. 8 is a partial perspective view of a configured die and the impaling device with flexible pointed fingers extending away from the die cylinder.

In an alternate embodiment, FIG. 8 shows a configured cutting die assembly 40 with cutting die 41 and flexible pointed fingers 42 including pointed tips 43 affixed to the die assembly by bolts 44 adjacent or within said die blades. Scrap pieces are impinged on said flexible pointed fingers as previously described and removed by a comb, brush or vacuum means. Resilient materials, which may be cork, sponge, rubber or any elastomeric material is positioned opposite to the flexible pointed fingers 42 on the anvil cylinder to impinge the scrap pieces so they may be impaled by the pointed fingers at the nip of the cylinders.

While particular embodiments and applications of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporated in those features which come within the true spirit and scope of the invention.

What is claimed is:

1. Apparatus for stripping scrap from a web, comprising: a pair of rolls rotatable in opposite directions about parallel axes in contact with opposite sides of the web; one roll carrying one or more flexible pointed fingers for impaling scrap; and the other roll having a resilient material directly opposed the flexible pointed fingers for impaling scrap onto the flexible pointed fingers.

2. The apparatus of claim 1 wherein means are provided for removing scrap from the flexible pointed fingers at a location away from the nip of the rolls.

3. The apparatus of claim 1 wherein the flexible pointed fingers are depressed into a downward movement by the other roll at the nip of the rolls wherein the fingers impinge scrap on the opposed resilient material and upon exiting the nip swing outward with the impaled scrap attached thereto, and the scrap is removed from the finger at a location away from the nip of the rolls.

4. The apparatus of claim 3 wherein the flexible pointed fingers swing outward from the roll attached thereto at an angle up to about 15 degrees from the roll.

5. The apparatus of claim 3 wherein the flexible pointed fingers are substantially parallel to the roll attached thereto when the web passes through the cutting nip of the rolls.

6. The apparatus of claim 1 wherein the resilient material is selected from the group consisting of cork, rubber or any elastomeric material.

7. The apparatus of claim 1 wherein the scrap is removed from the flexible pointed fingers by a comb.

8. The apparatus of claim 7 wherein the scrap is removed from the flexible pointed fingers by a comb and vacuum means.

9. In a rotary type paper cutting apparatus having a knife roller or die cutting cylinder and a cooperating anvil cylinder assembly against which the paper is cut, the improvement which comprises a knife roller or die cut cylinder assembly comprising:

(a) a double knife die attached to the surface of the knife roller of the die cut assembly;

(b) one or more flexible pointed fingers arranged substantially parallel thereto between the knives of the die, the flexible pointed finger being attached to the die cylinder in a manner so that it may flex outward from the surface of the die cylinder and having a pointed impaling means on the outward end thereof; and (c) resilient means attached to the surface of the anvil cylinder directly opposed the flexible pointed finger for engaging scrap pieces.

10. The apparatus of claim 9 in which the flexible pointed finger comprises: an end portion attached to the knife roller; a mid-portion; and a pointed end for impaling scrap pieces, the pointed end being substantially perpendicular to the mid-portion of the flexible pointed finger.

11. In a rotary type paper cutting apparatus having a knife roller or die cutting cylinder and a cooperating anvil cylinder assembly against which the paper is cut, the improvement which comprises a knife roller or die cut cylinder assembly comprising:

(a) a configured die attached to the surface of the knife roller of the die cut assembly;

(b) one or more flexible pointed fingers arranged adjacent the configured die, the flexible pointed finger being attached to the die cylinder in a manner so that it may flex outward from the surface of the die cylinder and having a pointed impaling means on the outward end thereof; and (c) resilient means attached to the surface of the anvil cylinder directly opposed the flexible pointed finger for engaging scrap pieces.

12. The apparatus of claim 11 in which the flexible pointed finger comprises: an end portion attached to the knife roller; a mid-portion; and a pointed end for impaling scrap pieces, the pointed end being substantially perpendicular to the mid-portion of the flexible pointed finger.

* * * * *